US009578900B2

(12) United States Patent
Abbott et al.

(10) Patent No.: US 9,578,900 B2
(45) Date of Patent: Feb. 28, 2017

(54) UPPER AND LOWER TORSO GARMENTS HAVING AN IMPROVED BAND

(71) Applicant: HBI Branded Apparel Enterprises, LLC, Winston-Salem, NC (US)

(72) Inventors: Michael D. Abbott, Statesville, NC (US); Roger D. Warren, Claremont, NC (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 0 days.

(21) Appl. No.: 14/716,418

(22) Filed: May 19, 2015

(65) Prior Publication Data

US 2015/0289568 A1 Oct. 15, 2015

Related U.S. Application Data

(62) Division of application No. 13/782,736, filed on Mar. 1, 2013, now Pat. No. 9,254,009.

(51) Int. Cl.

| | |
|---|---|
| ***A41B 9/14*** | (2006.01) |
| ***A41C 3/12*** | (2006.01) |
| ***A41C 1/12*** | (2006.01) |
| ***D04B 39/00*** | (2006.01) |
| ***A41F 9/00*** | (2006.01) |
| ***A41C 3/00*** | (2006.01) |
| ***A41B 9/00*** | (2006.01) |

(Continued)

(52) U.S. Cl.

CPC ..... *A41B 9/14* (2013.01); *A41B 9/001* (2013.01); *A41B 9/02* (2013.01); *A41B 9/04* (2013.01); *A41B 11/14* (2013.01); *A41C 1/003* (2013.01); *A41C 1/12* (2013.01); *A41C 3/0014* (2013.01); *A41C 3/12* (2013.01); *A41F 9/00* (2013.01); *D04B 39/00* (2013.01); *A41B 2300/22* (2013.01); *A41B 2500/10* (2013.01)

(58) Field of Classification Search

CPC ..... A41B 9/00; A41B 11/005; A41C 3/0014

USPC ..... 2/400–405, 406, 69, 228, 236, 237; 66/171, 177, 198, 196

See application file for complete search history.

(56) References Cited

U.S. PATENT DOCUMENTS

| | | | |
|---|---|---|---|
| 2,180,111 | A | 11/1939 | Kapinas |
| 2,971,514 | A | 2/1961 | Steinmetz |

(Continued)

FOREIGN PATENT DOCUMENTS

| | | | |
|---|---|---|---|
| CN | 1414900 | A1 | 4/2003 |
| CN | 101868210 | A | 10/2010 |

(Continued)

OTHER PUBLICATIONS

Office Action issued in Bangladesh Application No. 47/2014 on Aug. 6, 2015; 1 page.

(Continued)

*Primary Examiner* — Gloria Hale

(74) *Attorney, Agent, or Firm* — Fish & Richardson P.C.

(57) ABSTRACT

A circularly knitted upper or lower torso garment, such as a brassiere or brief, and method of forming a circularly knitted brassiere are provided, the garment having a circularly knitted body formed of inner and outer layers, the circularly knitted body having at least one torso or waist band, the inner and outer layers overlapping along a fold line, and an elastomeric band positioned between the inner and outer layers proximate the fold line.

8 Claims, 8 Drawing Sheets

(51) Int. Cl.

| | |
|---|---|
| ***A41B 9/02*** | (2006.01) |
| ***A41B 9/04*** | (2006.01) |
| ***A41B 11/14*** | (2006.01) |
| ***A41C 1/00*** | (2006.01) |

(56) References Cited

U.S. PATENT DOCUMENTS

| | | | | |
|---|---|---|---|---|
| 3,046,990 | A | 7/1962 | Dozier | |
| 3,322,127 | A | 5/1967 | Sachs | |
| 3,665,929 | A | 5/1972 | Brantly | |
| 3,750,193 | A | 8/1973 | Cooke | |
| 3,779,250 | A | 12/1973 | Radomski | |
| 3,813,698 | A | 6/1974 | Campbell, Sr. et al. | |
| 3,843,973 | A | 10/1974 | Dillenburger | |
| 3,848,266 | A | 11/1974 | Conaway et al. | |
| 3,987,496 | A | 10/1976 | Bernard | |
| 4,089,068 | A | 5/1978 | Swallow | |
| 4,324,254 | A | 4/1982 | Freedman et al. | |
| 4,332,034 | A | 6/1982 | Muse | |
| 4,549,317 | A | 10/1985 | D-Ambrosio | |
| 4,596,055 | A | 6/1986 | Aach et al. | |
| 4,771,483 | A | 9/1988 | Hooreman et al. | |
| 4,781,651 | A | 11/1988 | Ekins | |
| 4,816,005 | A | 3/1989 | Braaten | |
| 4,970,728 | A | 11/1990 | D'Ambrosio | |
| 5,037,348 | A | 8/1991 | Farino | |
| 5,119,511 | A | 6/1992 | Packer et al. | |
| 5,168,581 | A | 12/1992 | Garcia et al. | |
| 5,211,598 | A | 5/1993 | Hall | |
| 5,215,494 | A | 6/1993 | Flanagan | |
| 5,359,732 | A | 11/1994 | Waldman et al. | |
| 5,398,346 | A * | 3/1995 | Feinberg | D04B 1/243 2/400 |
| 5,483,702 | A | 1/1996 | D'Ambrosio | |
| 5,533,458 | A | 7/1996 | Bergland | |
| 5,572,888 | A * | 11/1996 | Browder, Jr. | D04B 1/18 2/401 |
| 5,746,068 | A | 5/1998 | Popa et al. | |
| 5,802,619 | A | 9/1998 | Ralston et al. | |
| 5,963,988 | A | 10/1999 | Jackson, Jr. | |
| 6,138,282 | A | 10/2000 | Follese | |
| 6,178,784 | B1 | 1/2001 | Marley | |
| 6,276,175 | B1 * | 8/2001 | Browder, Jr. | A41B 9/001 2/409 |
| 6,311,333 | B1 | 11/2001 | Batra | |
| 6,622,312 | B2 | 9/2003 | Rabinowicz | |
| 7,396,274 | B2 | 7/2008 | Wiegmann | |
| 7,927,180 | B2 | 4/2011 | Simpson | |
| 2002/0022433 | A1 | 2/2002 | Yeung et al. | |
| 2002/0129434 | A1 * | 9/2002 | Rabinowicz | A41C 3/0014 2/69 |
| 2002/0152775 | A1 * | 10/2002 | Browder, Jr. | A41B 9/001 66/170 |
| 2003/0192351 | A1 * | 10/2003 | Meckley | D04B 1/102 66/170 |
| 2003/0196252 | A1 * | 10/2003 | Blakely | A41B 11/005 2/400 |
| 2003/0230120 | A1 | 12/2003 | Mitchell et al. | |
| 2004/0014394 | A1 | 1/2004 | Mitchell et al. | |
| 2004/0198178 | A1 | 10/2004 | Mitchell et al. | |
| 2006/0021388 | A1 | 2/2006 | Mitchell et al. | |
| 2006/0277948 | A1 | 12/2006 | Sorensen | |
| 2007/0251636 | A1 | 11/2007 | Herbert | |
| 2012/0052769 | A1 | 3/2012 | Pearce et al. | |
| 2014/0041120 | A1 * | 2/2014 | Li | A61G 7/012 5/611 |
| 2014/0248822 | A1 | 9/2014 | Abbott et al. | |
| 2014/0259304 | A1 | 9/2014 | Mitchell et al. | |

FOREIGN PATENT DOCUMENTS

| | | |
|---|---|---|
| CN | 102083333 A | 6/2011 |
| EP | 0161823 | 11/1985 |
| EP | 1324674 B1 | 12/2005 |

OTHER PUBLICATIONS

International Search Report and Written Opinion for PCT/US2014/018566 dated May 16, 2014.

The State Intellectual Property Office of the People's Republic of China, Notification of First Office Action, Chinese Application No. 201480011621.8, Jun. 27, 2016, 12 pages.

PCT International Search Report and Written Opinion of the International Searching Authority, PCT/US2016/050248, Nov. 18, 2016, 13 pages.

* cited by examiner

UPPER AND LOWER TORSO GARMENTS HAVING AN IMPROVED BAND

CROSS-REFERENCE TO RELATED APPLICATIONS

This application is a Divisional of and claims the benefit of priority to U.S. application Ser. No. 13/782,736, filed on Mar. 1, 2013 and entitled "Upper and Lower Torso Garments having an Improved Band", the contents of which are hereby incorporated by reference.

The invention relates to circularly knitted upper and lower torso garments, such as a brassiere or brief. More particularly, the present invention relates to a circularly knitted brassiere and a lower torso undergarment having an improved chest band and waist band, respectively, affixed between the overlapping plies of fabric.

BACKGROUND OF THE INVENTION

Field of the Invention

Upper torso garments, such as, brassieres generally and sports bras in particular have a torso encircling band that is knitted at or attached to the lower edge of the brassiere to provide stability and additional support to the wearer. Such bands also are knitted at or attached to the upper edge of lower torse undergarments, such as briefs, to function as a waist band. One known way to form a chest band or waist band is to knit a turned welt during the process of knitting the fabric tube. An alternative method is to stitch an elastomeric band to the bottom edge of the brassiere, or the top edge of the brief, around the entire periphery; this additional step requires additional labor and increases costs. The resulting band tends to be relatively bulky and thick, and, therefore more visible and less comfortable when worn.

SUMMARY OF THE INVENTION

An aspect of the present invention is a circularly knitted garment, such as a brassiere or brief, having a thin elastomeric band affixed between overlapping plies of knitted fabric. In one exemplary embodiment, the elastomeric band comprises a thin polyamide film having a modulus (kilograms of holding power) that is greater than can be achieved by conventional elastomeric yarns, such as spandex and Lycra®. The modulus of the plies and film combined may be between about 1.0 kg and 4 kg. As used herein, the term "modulus" refers to the kilograms of recovery force available in the material at a given percentage of stretch. The greater the modulus, the stiffer the material, i.e. the more resistant the material will be to linear stretch. Depending upon the type of elastomeric material, its width and thickness, its modulus may vary widely.

Another aspect of the present invention is a method of forming a brassiere or lower torso undergarment having an elastomeric band affixed between the overlapping plies of fabric. The method comprises circularly knitting a body that is symmetrically dimensioned for forming a two-ply garment, comprising inner and outer layers when folded about a central fold line. The elastomeric band is positioned proximate the fold line and the plies are symmetrically overlapped about the fold line, thus enclosing the elastomeric band and forming the two-ply garment with a torso band that is thinner and, therefore, less visible and more comfortable when worn. In one embodiment, the elastomeric band is affixed to one or both of the inner and outer layers of knitted fabric by the application of temperature and pressure for a selected amount of time.

BRIEF DESCRIPTION OF THE DRAWINGS

The present invention will be more apparent from the following detailed explanation of embodiments of the invention in connection with the accompanying drawings.

DETAILED DESCRIPTION

One aspect of the present invention is directed to an upper torso garment, such as, a brassiere, a sports bra or a camisole. Referring to FIGS. 1-6 in general, a circularly-knitted brassiere is shown generally as 100. The circularly-knitted brassiere 100, which is formed on a conventional circular knitting machine, may comprise a two-ply brassiere body having overlapping inner 112 and outer 114 layers, or plies. While a two-ply brassiere is illustrated and described herein, the invention is not limited to a two-ply garment; rather, one-ply garments, such as brassieres and lower torso undergarments, are within the scope of the invention.

The brassiere body may be formed of any of the conventional materials such as polyester, nylon, etc. The body may be formed by also knitting in one or more elastomeric yarns, such as spandex, having some degree of elasticity for securing the garment about the wearer's torso. Each ply of fabric for the embodiments described herein may be between about 0.6 mm and about 2.0 mm thick.

Figure 1:
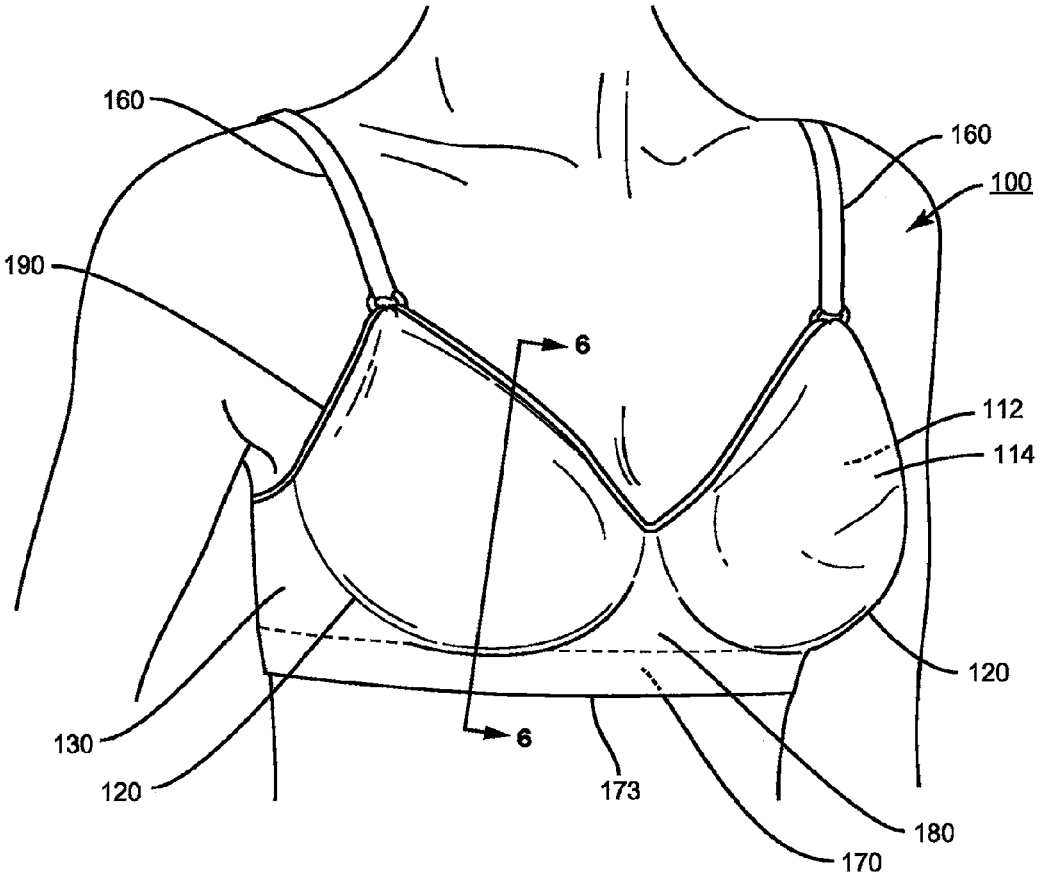
FIG. 1 is a front perspective environmental view of the brassiere of the present invention.
Figure 2:
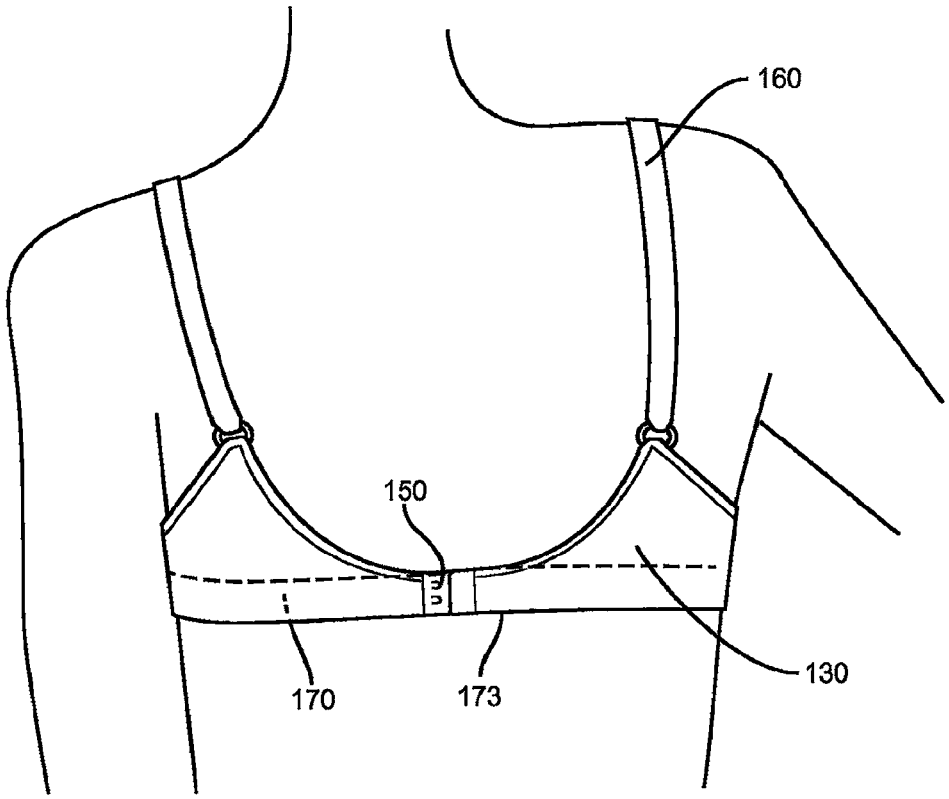
FIG. 2 is a rear perspective environmental view of the brassiere of FIG. 1, illustrating an embodiment having a rear closure.
Figure 3:
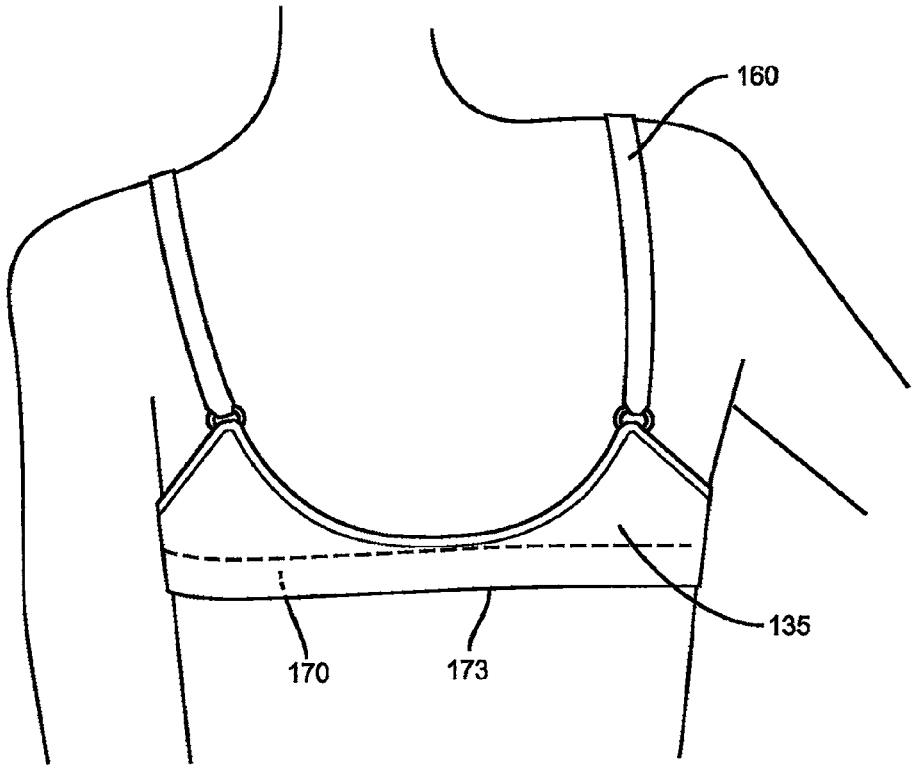
FIG. 3 is a rear perspective environmental view of the brassiere of FIG. 1, illustrating a sports-type bra embodiment without a rear closure.
Figure 4:
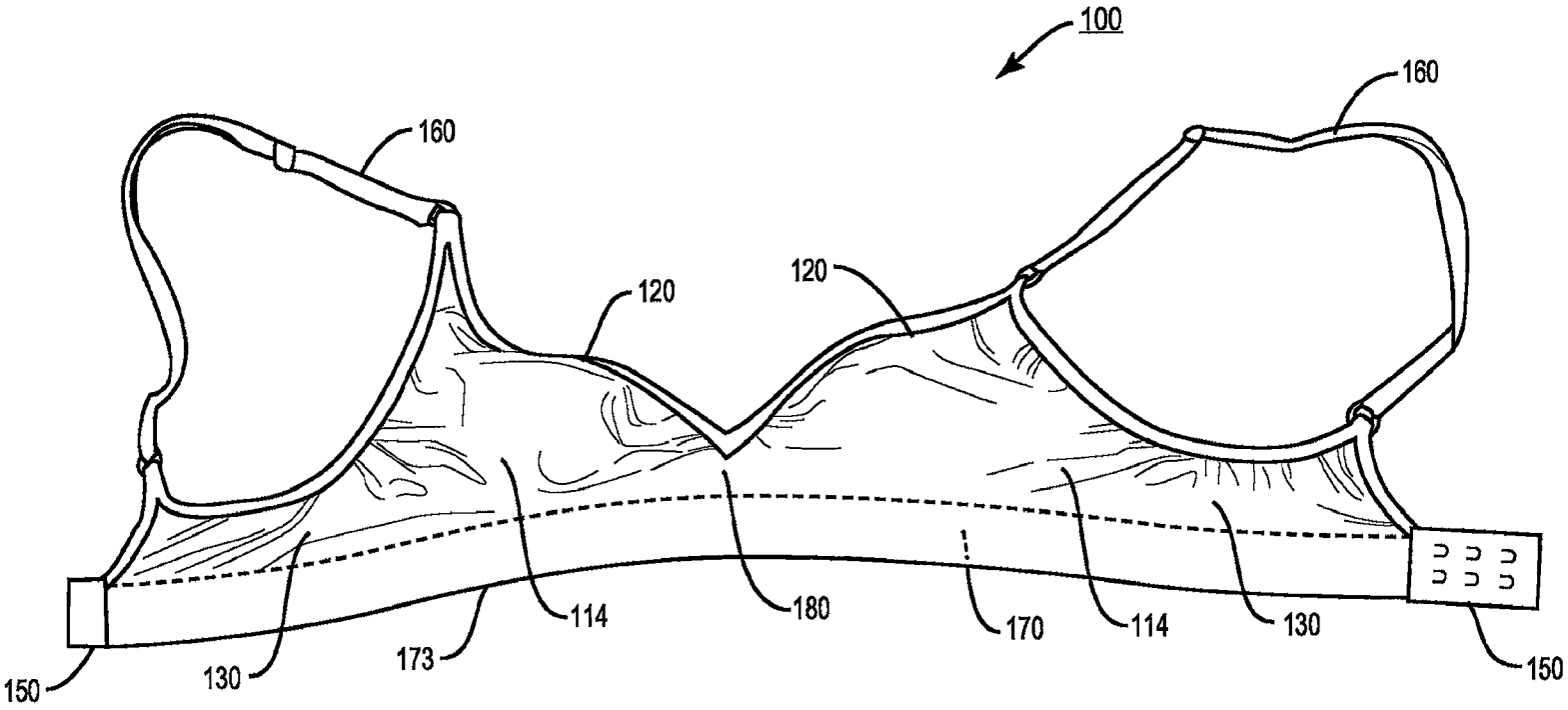
FIG. 4 is a front view of the brassiere of FIGS. 1 and 2.
Figure 5:
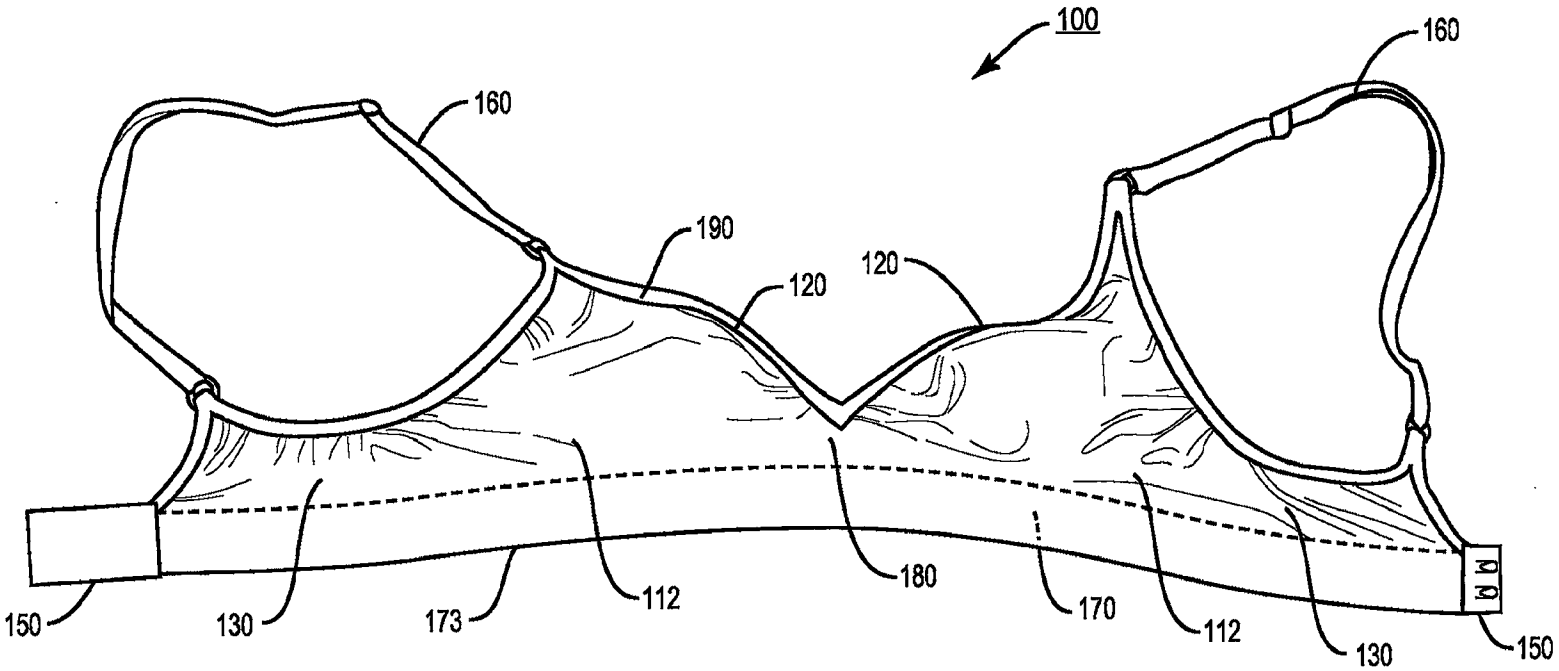
FIG. 5 is a rear view of the brassiere of FIGS. 1 and 2.

As shown in FIGS. 2, 4 and 5, the brassiere disclosed herein comprises a pair of breast cups 120, and a torso encircling strap 130 extending outwardly from the outer edges of each breast cup 120, with the two torso straps 130 fastening at the back of the wearer with fasteners 150. In the exemplary embodiment shown in FIG. 3, a single continuous torso strap 135 extends between the outer edges of the breast cups 120 to encircle the torso of the wearer. This embodiment is typical of a pullover sports-type brassiere. Further, the breast cups 120 may be either molded after the brassiere body is formed, or may be knitted in as loose areas on the front of the body during the knitting process.

As shown in FIGS. 1-6, an elastomeric band 170 is inserted along the bottom of the brassiere 100, between the inner 112 and outer 114 plies, and extends beneath the breast cups 120, the central gore 180, and along the lower edges of the torso straps 130, 135.

Figure 6:
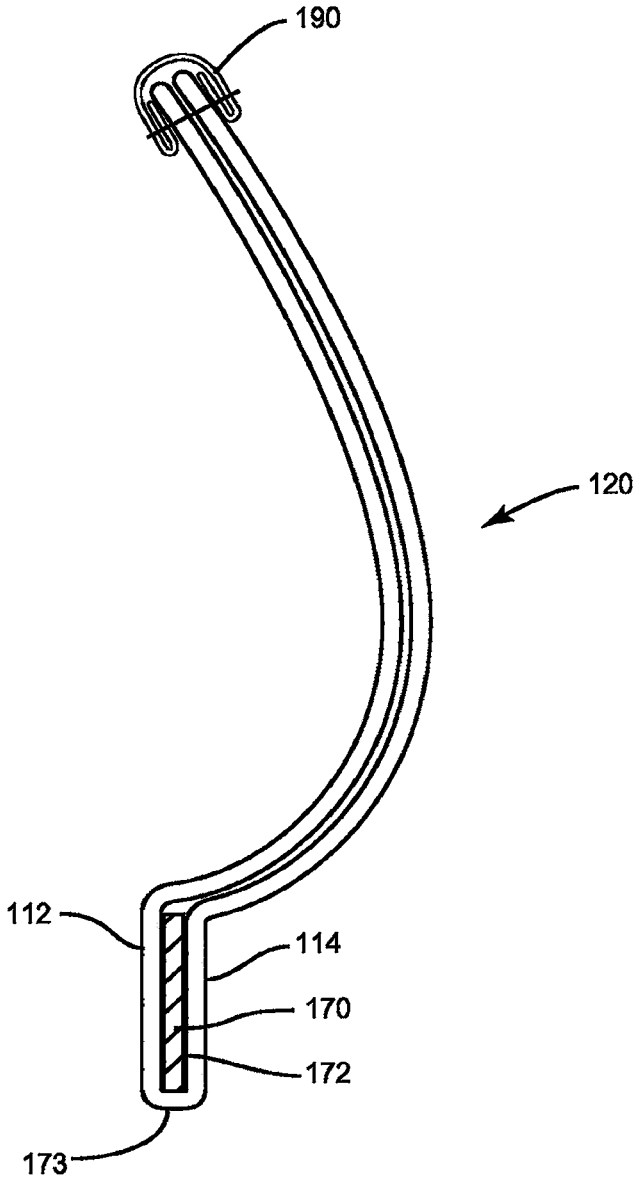
FIG. 6 is a cross-sectional view of the brassiere of FIG. 1, taken along Line 6-6.

Turning now to FIG. 6, the elastomeric band 170 of the brassiere 100 comprises a relatively thin elastomeric material having an improved modulus and that maintains a relatively consistent modulus across a useful range of elongation. Depending upon the type and style of the brassiere 100, the thickness of the elastomeric band 170 may range from between about 0.010 mm and 0.45 mm to reduce the visibility of the elastomeric material when the garment is worn. The optimal thickness of the elastomeric band 170 will depend on the desired level of control to be provided for the brassiere 100, which is typically size dependent. As will be appreciated, the thinner the elastomeric band 170, the less visible the band when worn. The degree of control and support for the brassiere 100 type and style also depends on the width of the elastomeric band 170. The width of the elastomeric band 170 can range from about one-quarter (¼) inch for a minimally supporting bra up to seven (7) or more inches wide for a lower torso control garment. An optimal width for the exemplary embodiments illustrated herein is between about three-quarters (¾) inch and one and one-quarter (1¼) inches.

In one embodiment, the elastomeric band 170 comprises a thin film of thermoplastic elastomer (TPE). The thermoplastic elastomer may comprise a polyamide blend. One such polyamide blend is available under the trademark Pebax® from Arkema Inc. of King of Prussia, Pa. Other thin elastomeric materials, including other films, having the physical properties described below, may be suitable to form the elastomeric band 170.

By way of example and comparison, for the exemplary embodiments shown herein, a typical knitted-in torso band, e.g., a turned welt, would be approximately 2.0 mm thick. A cut and sew brassiere with a sewn in elastic band of similar weight to the turned welt would be approximately 1.8 mm thick. A band having the polyamide film would be approximately 1.5 mm thick.

The modulus of the elastomeric material depends on its type of material, width and thickness. In the exemplary embodiments described herein, an optimal modulus may be between about 1.0 and 4.0 kilograms. As shown in the several examples in Table 1 below, this range in the modulus corresponds to between about 95% and 140% in deformation (stretch) when the elastomeric band 170 is subjected to a length direction static load of 7 kilograms.

TABLE 1

| Elastomeric Band Material | Thickness of Elastomeric Band | Modulus (kg) (40% elongation) (band plus plies) | Modulus (kg) (60% elongation) (band plus plies) | Total Percent Deformation (band plus plies) |
|---|---|---|---|---|
| Pebax ® | 0.10 mm | 1.08 | 1.66 | 132% |
| Pebax ® | 0.15 mm | 1.59 | 2.25 | 123% |
| SBC by Kraton ® | 0.30 mm | 2.31 | 3.50 | 102% |

By way of comparison, the body of brassiere 100 will have a modulus of less than 1 kilogram. For example, the two overlapped plies, formed from a conventional blend of 89% weight nylon and 11% weight spandex has a modulus of about 0.132 kg at 40% elongation and about 0.35 kg at 60% elongation. As seen in Table 1 above, the elastomeric bands provide a reduced increase in modulus with increased elongation. This produces a brassiere 100 that will be comfortable over a larger range of sizes. In the torso band region at the bottom of the brassiere proximate the fold line 173, the two-ply body material alone would allow for elongation of 160% when tested under the same 7 kg load as the samples in Table 1.

Referring again to FIG. 6, the method of forming the brassiere 100 of the present invention is best illustrated. The brassiere body or blank is knitted in the form of a tube on a conventional circular knitting machine. The center periphery of the tube corresponds to the fold line 173 about which the inner 112 and outer 114 layers will be overlapped into the two-ply brassiere body.

The elastomeric band 170 is positioned proximate the center fold line 173 on what will become the inner surfaces of the two-ply brassiere body when the tube is folded. The elastomeric band 170 may be coated on one or both sides with a heat-sealable adhesive 172 for adhering the elastomeric band 170 in position once the brassiere construction is complete. One suitable heat-sealable adhesive 172 is RX 2641, available from Bixby International Corp. of Newburyport, Mass. The invention, however, is not limited to using a heat-sealable adhesive to adhere the band 170; rather, the use of other suitable materials and methods for securing the band to the garment are within the scope of the invention.

The inner 112 and outer 114 layers of the brassiere body are next symmetrically overlapped about the fold line 173, enclosing the elastomeric band 170 and forming the two-ply brassiere body as described above. Where a heat-sealable adhesive 172 is applied to one or both sides of the elastomeric band 170, the elastomeric band 170 is affixed between the two plies with an air-operated press having upper and lower heating elements. An application temperature may be between about 150 degrees Fahrenheit and 380 degrees Fahrenheit, preferable about 320 degrees Fahrenheit. The application pressure should be no less than about 10 psi and no more than about 120 psi, preferably between about 30 and about 60 psi. The preferred pressure should be applied for no less than about 5 seconds and no more than about 90 seconds, preferably between about 20 and about 30 seconds.

Once the elastomeric band 170 is adhered between the inner 112 and outer 114 layers, the brassiere body may be cut to the desired shape. Subsequently, trim 190 is applied along the free edges, shoulder straps 160 attached, and fasteners 150 are affixed to complete the brassiere 100 construction. Where shoulder strap portions 160 are formed and cut with the brassiere body, they need only to be seamed together proximate the top of the shoulder. Similarly, where the torso strap 135 is continuous, no fasteners 150 are necessary.

Figure 7:
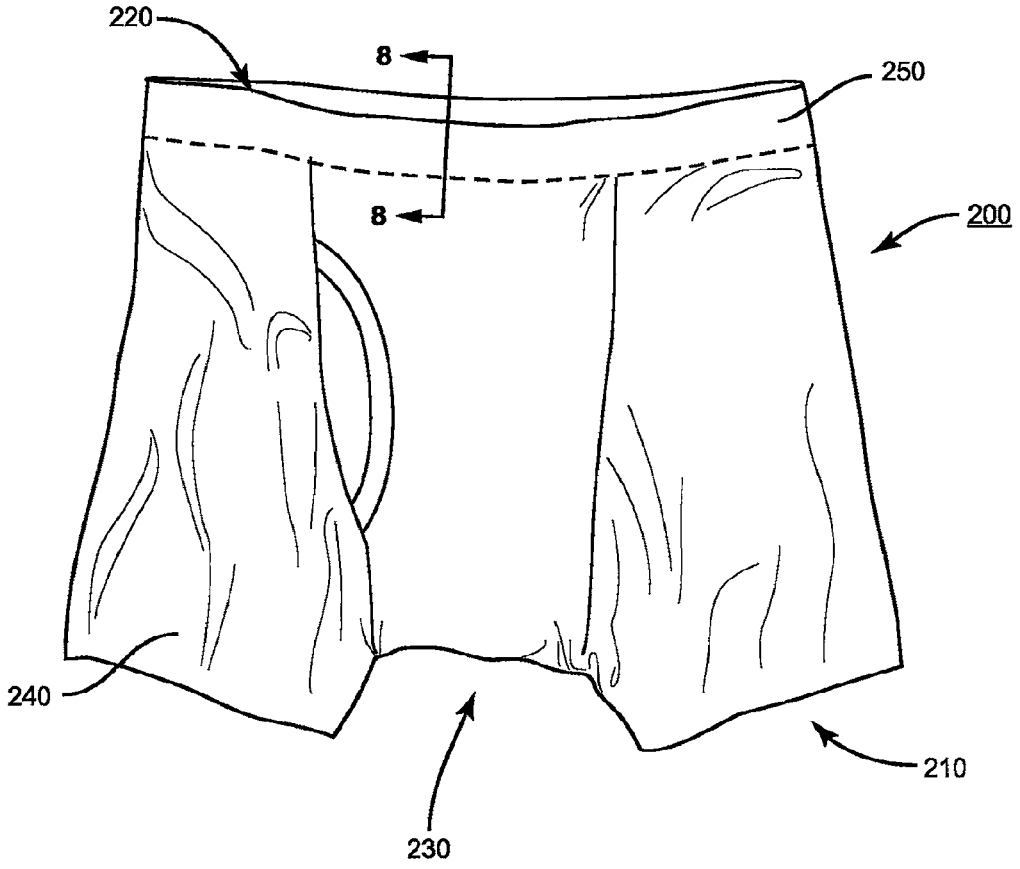
FIG. 7 is a front perspective environmental view of boxer briefs of the present invention.
Figure 8:
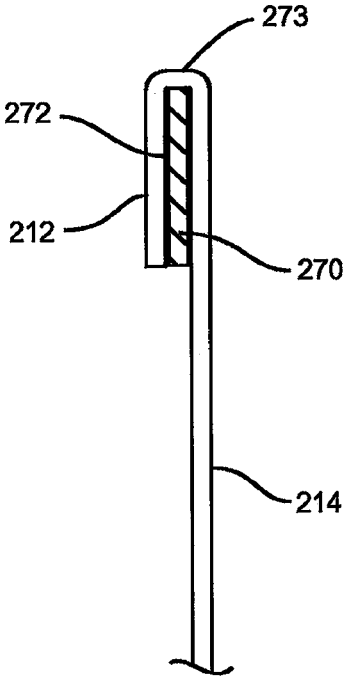
FIG. 8 is a cross-sectional view of the briefs of FIG. 7, taken along line 8-8.

Another aspect of the present invention is directed to a circularly-knitted lower torso undergarment, such as a boxer, a brief, a boxer brief, panties, pantyhose or shapewear. Referring to FIGS. 7 and 8, a boxer brief is shown generally as 200. The circularly-knitted brief 200, which is formed on a conventional circular knitting machine, comprises a body formed of any of the conventional materials such as polyester, nylon, etc. The body may be formed by also knitting in one or more elastomeric yarns, such as spandex, having some degree of elasticity for securing the garment about the wearer's lower torso.

The briefs 200 of the present invention comprises a pair of leg openings 210, a crotch portion 230 and a waist opening 220 surrounded by a waist band 250 of the present disclosure. The embodiment illustrated includes leg portions 240 as is typical of boxer style briefs. Conventional briefs, i.e. without leg portions 240, for males or females having the waist band 250 are also within the scope of the invention.

As best seen in FIG. 8, an elastomeric band 270, as described above, is inserted along the waist opening 220 of the brief 200, between inner 212 and outer 214 plies. Both the inner and outer plies 212, 214 are formed as parts of a single tube created by a circular knitting machine. The top portion of the tube is then folded downward along a top fold line 273 to form the waist band 250 having two plies, the elastomeric band 270 disposed adjacent to the fold line 273 and covered by the two plies. The elastomeric band 270, inner ply 212 and outer ply 214 may be held in place by adhesive 272, set using heat and pressure similar to the method discussed above. Alternate methods of adhering the elastomeric band to the body of the brief 200 are within the scope of the present invention.

It should be understood that the foregoing descriptions and examples are only illustrative of the invention. Various alternatives and modifications thereof can be devised by those skilled in the art without departing from the spirit and scope of the present invention. Accordingly, the present invention is intended to embrace all such alternatives, modifications, and variations.

We claim:

1. A lower torso garment, comprising:

a. a circularly knitted body, the circularly knitted body having a pair of leg openings, a crotch portion between the leg openings and a waist opening;

b. a waist band formed at the waist opening by folding a portion of the knitted body to provide an inner and an outer layers overlapping along an upper fold line; and c. an elastomeric band comprising a thermoplastic elastomer film and positioned between the inner and outer layers proximate the upper fold line;

wherein the thermoplastic elastomer film has a thickness between about 0.1 mm and about 0.3 mm; and wherein the modulus of the thermoplastic elastomer film is between about 1.0 and about 4.0 kilograms when measured with a static load of 7 kilograms at 60% elongation.

2. The lower torso garment of claim 1, wherein the thermoplastic elastomer film comprises polyamide.

3. The lower torso garment of claim 1, wherein the thermoplastic elastomer film has a modulus that is greater than the modulus of the circularly knitted body.

4. The lower torso garment of claim 1, wherein the elastomeric band is coated on at least one side for adhesively affixing the elastomeric band to at least one inner surface of the inner and outer layers of the circularly knitted body.

5. The lower torso garment of claim 1, wherein the garment is a boxer, a brief, a boxer brief, panties, pantyhose or shapewear.

6. The lower torso garment of claim 1, wherein the thermoplastic elastomer film comprises a width between about 0.75 inches and about 1.25 inches.

7. The lower torso garment of claim 1, wherein the modulus of the thermoplastic elastomer film is greater than about 1.0 kilograms when measured with a static load of 7 kilograms at 40% elongation.

8. The lower torso garment of claim 1, wherein the modulus of the thermoplastic elastomer film plus the inner and outer layers of the garment is between about 1.0 and about 4.0 kilograms when measured with a static load of 7 kilograms at 60% elongation.

* * * * *